US007195102B2

(12) United States Patent
Shai

(10) Patent No.: US 7,195,102 B2
(45) Date of Patent: Mar. 27, 2007

(54) TELESCOPIC STOOL

(76) Inventor: Moti Shai, 3524 Vin del Prado, Calabasas, CA (US) 91302

( * ) Notice: Subject to any disclaimer, the term of this patent is extended or adjusted under 35 U.S.C. 154(b) by 369 days.

(21) Appl. No.: 10/353,659

(22) Filed: Jan. 29, 2003

(65) Prior Publication Data

US 2004/0144593 A1 Jul. 29, 2004

(51) Int. Cl.
*A63B 25/00* (2006.01)

(52) U.S. Cl. ..... 182/230; 482/75
(58) Field of Classification Search ..... 182/230; 482/75
See application file for complete search history.

(56) References Cited

U.S. PATENT DOCUMENTS 1,190,421 A * 7/1916 Kalcy ..... 482/75
3,660,920 A * 5/1972 Spina ..... 482/75
4,255,822 A * 3/1981 Dixon ..... 623/28
4,415,063 A * 11/1983 Hutchison ..... 182/230

* cited by examiner

*Primary Examiner*—Alvin Chin-Shue

(57) ABSTRACT

A system and method for providing a telescopic stool for enabling a user stable and practical elevated working environment. The system enables the user to climb up or down and to move horizontally relative to a surface, increased and enhanced horizontal mobility, stability, portability, and height adjustability in an economical and lightweight telescopic stool.

15 Claims, 4 Drawing Sheets

TELESCOPIC STOOL

BACKGROUND OF THE INVENTION

1. Field of the Invention

The present invention relates generally to improvements in devices for enabling a user to climb up or down relative to a surface and providing safe and practical elevated working environment with enhanced horizontal mobility. In particular, it relates to a new and improved system and method for providing a telescopic stool.

2. Description of the Related Art

Painters, plasterers, electricians and the like, frequently require heavy ladders, platforms and like stable supports in order to reach elevated and/or inaccessible work areas with safety. However, much time and effort are usually expected in moving such supports into place and shifting them around from location to location as the work progresses. It would be far more convenient and efficient if a stable, light weight and portable means of elevating the worker could be used, particularly means which could be easily and safely adjusted in height and effortlessly shifted from location to location without discontinuing the work.

A variety of systems and methods have been developed over the years for elevating the worker while providing different height adjustability and increased horizontal mobility, but usually these systems impractical, unsafe and very unstable.

The system and the methods of the present invention are particularly useful for enabling safe, efficient and effective climbing up or down relative to a surface, and providing a practical, economical and lightweight telescopic stool for enhanced horizontal mobility, while providing safe elevated working environment.

It would be desirable to provide a telescopic stool which:

(a) Provides safe, stable, efficient and practical elevated working environment;

(b) Provides ability of safe climbing up and down;

(c) Enables easy and practical horizontal mobility;

(d) Contains less material and parts for increased economy and efficiency;

(e) Is lighter in weight for greater mobility;

(f) Provides individual cylinder-step height adjustability without discontinuing the work;

(g) Provides convenient portability;

Therefore, the present invention provides improved systems and methods for providing a simple, safe, efficient, effective and very practical usage of the telescopic stool. The inventions disclosed herein satisfy these and other needs, still further objects and advantages of this invention will become apparent from a consideration of the drawing and ensuing description.

SUMMARY OF THE INVENTION

Briefly and in general terms, the present invention provides a new and improved system and method for providing a user with safe and practical elevated working environment, while providing enhanced height adjustability of the cylinder-step system and safe and stable horizontal mobility and portability.

More particularly, in an embodiment of the present invention, a telescopic stool system is provided for enabling a user to climb up and down as well as practical and safe elevated working environment and horizontal mobility. In one embodiment, the system includes an additional hands support system as well as tools and the like holder. Further, the system includes stool cylinder-step base plates for required stability, on top of which cylinders for telescopic height adjustability, on top of which pair of pedals to support user's feet, vertical plate pivotally connected to both cylinder-step to provide stable working environment and safe mobility. The system provides height adjustability of individual cylinder-step without discontinuing the work.

The above objects and advantages of the present invention, as well as others, are described in greater details in the following description, when taken in conjunction with the accompanying drawing of illustrative embodiments.

DETAILED DESCRIPTION OF THE PREFERRED EMBODIMENTS

Figure 1:
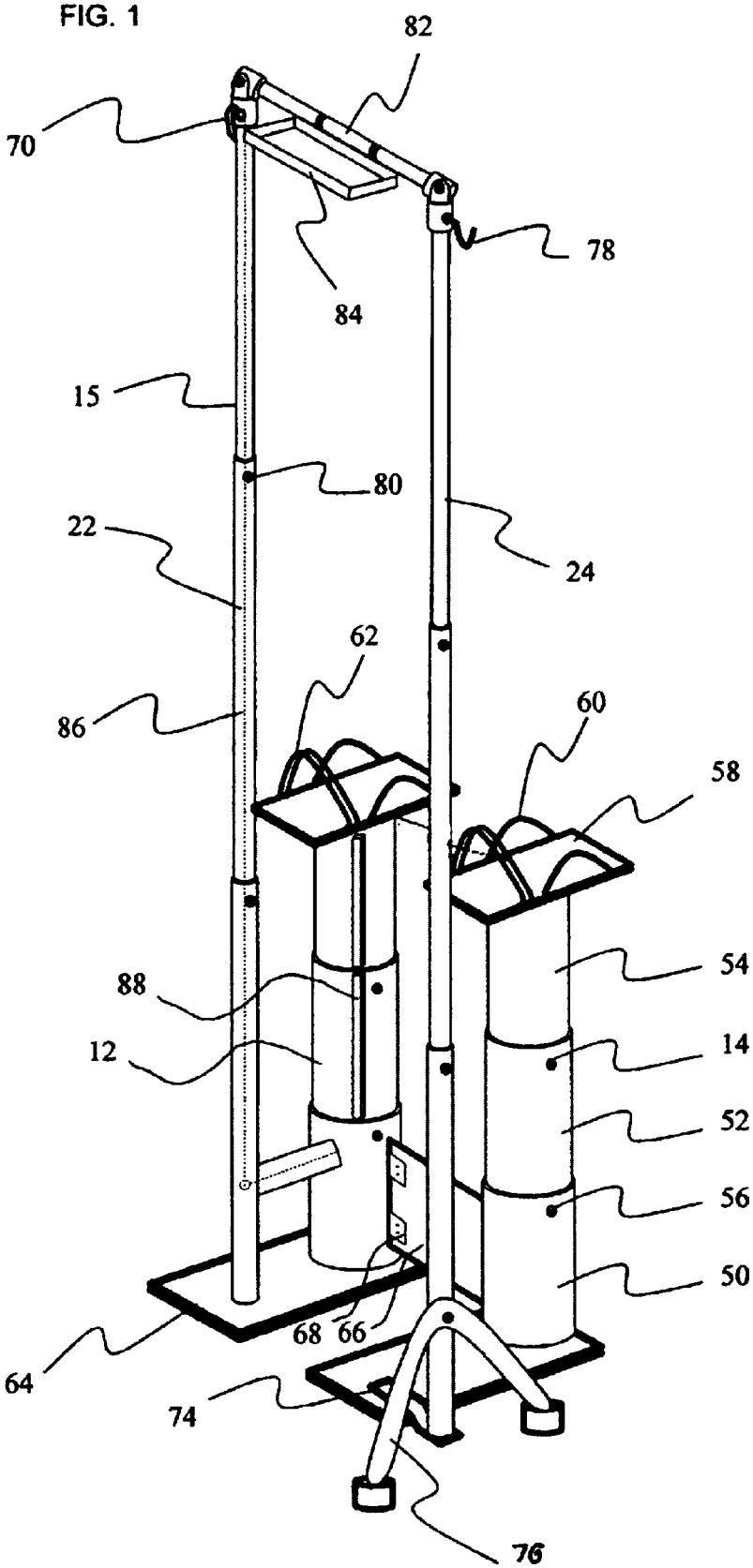
FIG. 1 is a perspective view of preferred embodiment of a Telescopic Stool in its fully extended form.
Figure 2:
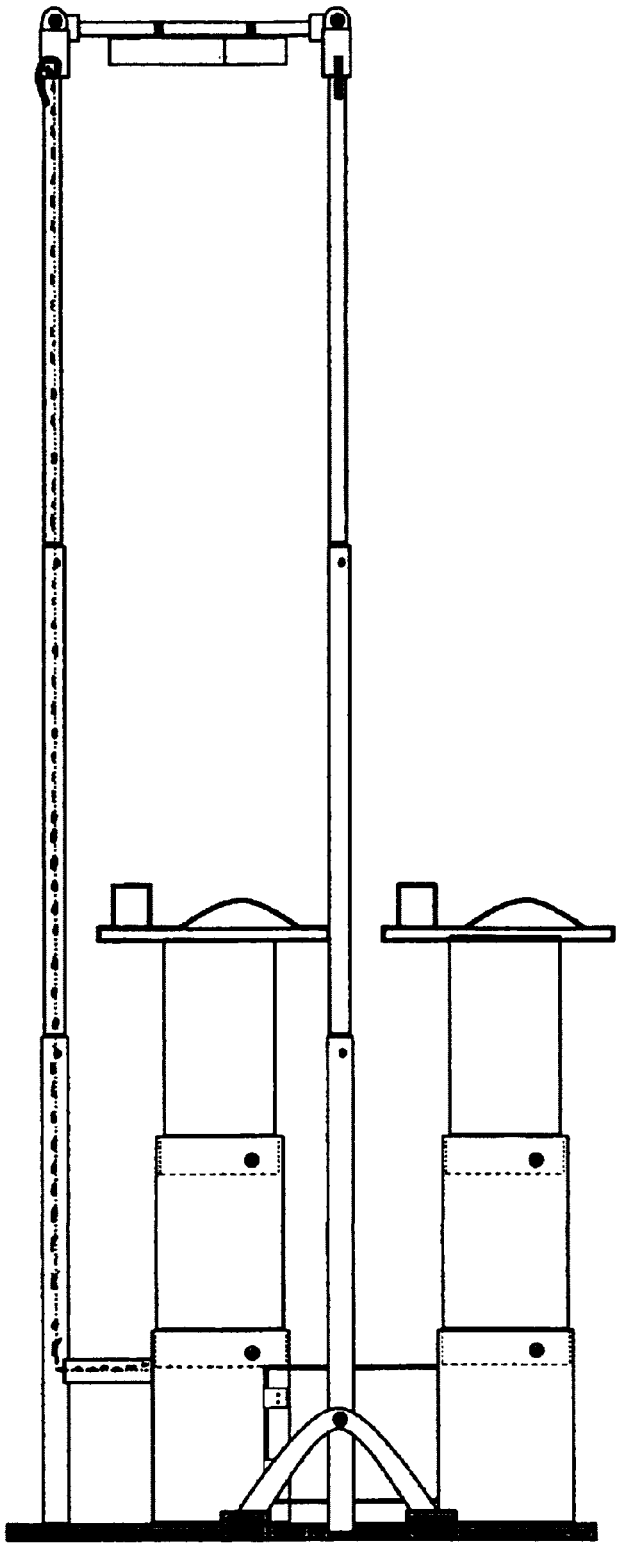
FIG. 2 is a side view that shows clearly preferred embodiment of the current invention in motion in its fully extended form.
Figure 8:
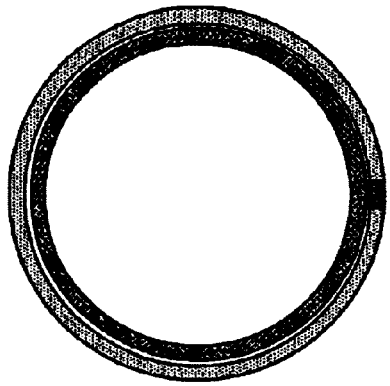
FIG. 8 is a sectional top view of two cylinders in their full extended position, clearly shows the trail attached along the inner cylinder and the guide along the inside of the outer cylinder, to prevent rotational movement between the cylinders.
Figure 3:
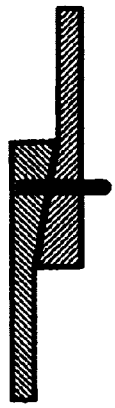
FIG. 3 is a sectional exploded view that shows clearly a conical parts of the cylinders edges to prevent free movements between the cylinders in their extended position for better stability.
Figure 4:
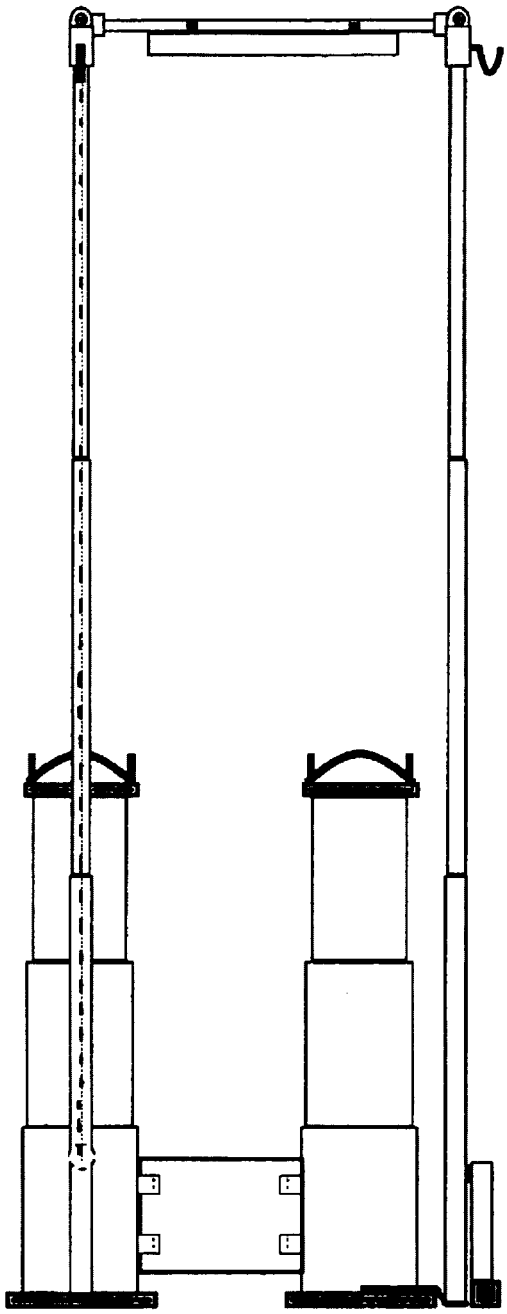
FIG. 4 is a front view that shows preferred embodiment of the current invention in its fully extended form.
Figure 5:
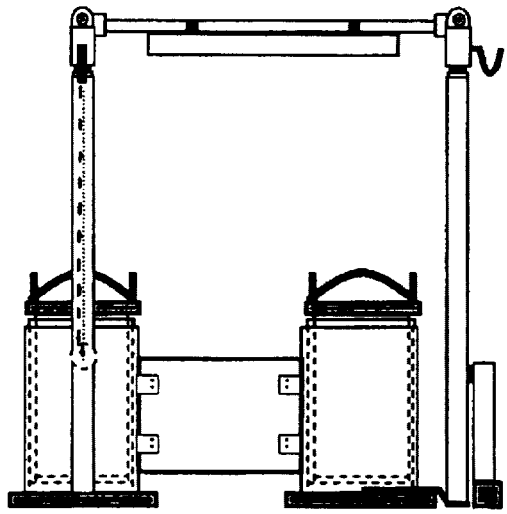
FIG. 5 is a front view that shows preferred embodiment of the current invention in its fully folded form.

The present invention is directed to an improved system and method for providing a user safe and efficient elevated working environment and enabling the user to climb up or down and to move horizontally relative to a surface, in an efficient and effective manner. The invention provides a telescopic stool, which is economical and lightweight, and which enables increased and enhanced horizontal mobility. The system is easy and convenient to fold up for portability and storage purposes. The present invention further provides stability and height adjustability. The preferred embodiments of the improved system and method are fully and detailed illustrated and described in the following paragraphs.

In the drawing, wherein like reference numerals denote like or corresponding parts throughout the drawing figures, and particularly in the preferred embodiments in accordance with the invention as shown in FIGS, 1–7, for example, a system 15 is provided for safe and efficient elevated working environment and enabling the user to climb up or down and to move horizontally relative to a surface, constituting a Telescopic Stool.

As illustrated in FIGS. 1–5, and FIG. 8, in a preferred embodiment in accordance with the present invention, for example, the system 15 comprises right and left cylinder-steps 12 and 14 to support and provide the user stable elevated working environment. Every cylinder-step comprises a lower cylinder 50, a middle cylinder 52 disposed in the lower cylinder 50 in telescoping relation therewith and extending upwardly therefrom, and an upper cylinder 54 disposed in member 52 in telescoping relation therewith and extending upwardly therefrom. Cylinders 50, 52, and 54 include built-in conical edges, being best shown in exploded FIG. 3, to minimize free space between the cylinders, and pushpins 56 to lock every cylinder in its extended position.

Cylinders 50, 52, and 54 further include trails 88, attached along the cylinders, to prevent rotational movement.

Pedals 58, for supporting user's foot, located on top of and connected to the upper cylinders 54. The pedal 58 include a shoe strap 62 for better foot support. Pedal 58 further include foot side support 60, on each side of the pedal 58, that required in order to rotate the pedal 58 horizontally in clock-wise and counter-clock-wise directions in order to operate horizontally-pivot system 16, being best shown in FIG. 6 and will be described in details later, in order to unlock and to lower down middle and upper cylinders 52 and 54 of the left cylinder-step 14. Similar horizontally-pivot system 16 is used to lower the upper cylinder 54 of the right cylinder-step 12. Upper section of the lower cylinder 50 include a spring-loaded system 20, being best shown in FIG. 7 and will be described in details later, is used to unlock and to lower middle cylinder 52 of the right cylinder-step 12. Lower cylinder 50, of every cylinder-step 12 and 14 located on top of and connected to rectangular base plate 64 to provide better support and stability of the current invention. Vertically rectangular plate 66 is flexibly attached, by using pivot connectors 68, to the lower cylinders 50 of both cylinder-steps 12 and 14 providing the user ability to move horizontally one cylinder-step at a time while adding more control and stability to the current invention by completely preventing fall-downs.

System 15 further comprises right and left vertical telescopic hand-support systems 22 and 24 including three telescopic tubular members each. Every tubular member includes one pushpin 80 in order to lock this tubular member in its fully extended position. The right vertical hand-support 22 is statically connected through its bottom member to the base plate 64. Telescopic hand-support systems 22 farther include a trigger 70 that triggers on and off the spring-loaded system 20, being best shown in FIG. 7 and will be described later, to provide the ability to unlock the middle cylinder 52 of the right telescopic cylinder-step 12. The bottom member of the right telescopic hand-support system 22 is connected to the lower cylinder 50 through horizontal tubular member 72 for better stability while providing a shelter for the connection between the trigger 70 and the spring-loaded system 20.

The left hand-support system 24 is connected to the base plate 64 through pivotally moving rectangular strap 74 to provide rotational flexibility for better stability and safety of the preferred embodiment. Left hand-support system 24 further includes an extra arm support 76 for better safety and stability of the telescopic hand-supports and for the overall stability of system 15. Left hand-support system 24 further includes a hook 78 to provide an extra hanging ability for the tools, cans and the like.

Horizontal tubular member 82 is connecting the upper members of the telescopic hand-support systems 22 and 24 by means of providing horizontal and vertical move of every hand-support system individually. Member 82 further includes a horizontal tools tray 84.

Figure 6:
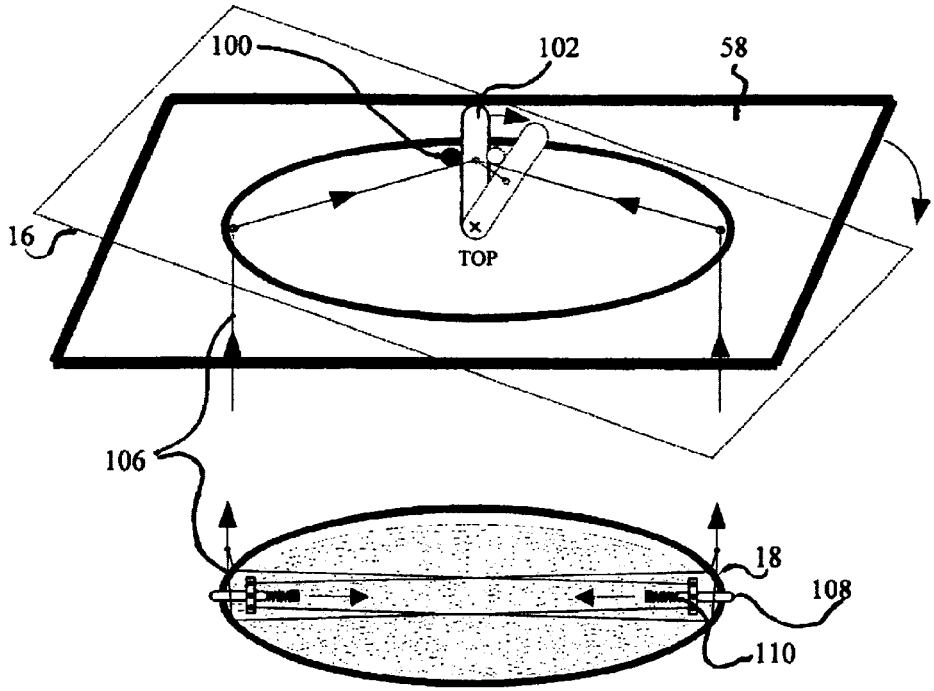
FIG. 6 is a sectional perspective view that shows a method to unlock upper cylinder in both cylinder-steps and to unlock middle cylinder on the left cylinder-step of the preferred embodiment.

As illustrated in FIG. 6, which presents a sectional perspective view, system 16 comprises two pins 100, for clear presentation we will concentrate on one half of the system 16, that operates one cylinder, the other half works exactly the same on the other cylinders of the cylinder-steps 12 and 14, attached to the bottom of the pedal 58, which is schematically displayed. System 16 further includes a pivotally-flat-strap 102 located beneath the pedal 58, which stretches horizontally from the center, which presents the origin of the rotation, of the upper cylinder towards the edge of the cylinder. Control wires 106 or the like connecting system 16, that responsible for stretching and loosing these wires 106, to system 18, which actually pulls plurality of pins 108 inward the cylinder when the wires 106 are stretched. Pins 108 pushed outward by the build in strings 110 when the wires 106 are loose. Systems 18 are located at the bottom of the upper 54 and middle 52 cylinders of the left cylinder-step 14 and at the bottom of the upper cylinder of the right cylinder-step 12.

Figure 7:
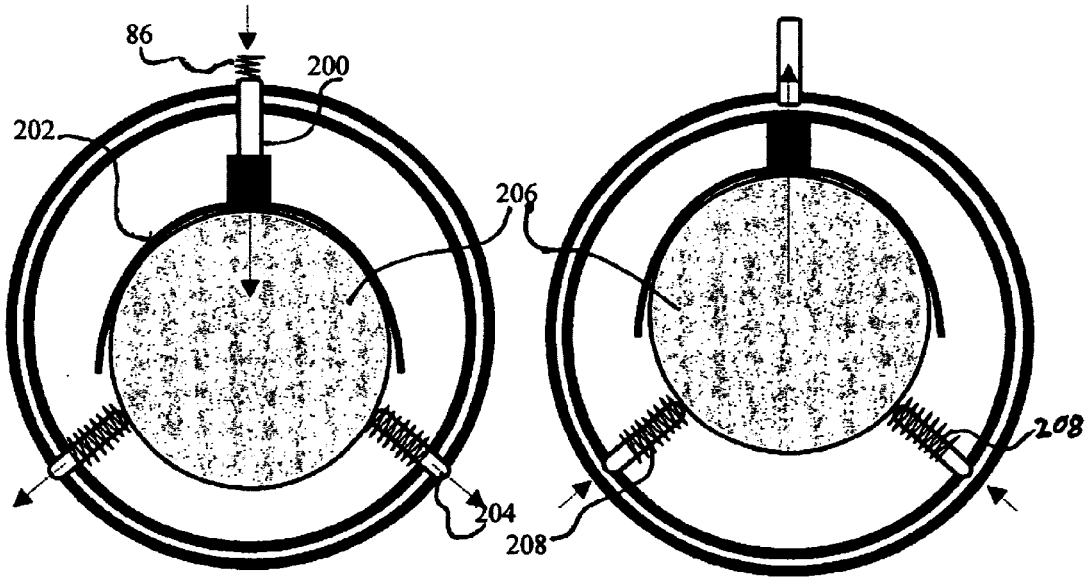
FIG. 7 is a sectional top view that shows a method to unlock middle cylinder on the right cylinder-step of the preferred embodiment.

As illustrated in FIG. 7, which presents a sectional top view, system 20, located at the top of the upper cylinder 50 of the right cylinder-step 12. This system is responsible to unlock middle cylinder 52 of the right cylinder-step 12. Pivotally rotating trigger 70, being best shown in FIG. 1, pulls the wires 86, located inside the right hand support system 22, that pulls pin 200 which release the pressure on disk leader 202, then springs 208 pulls pins 204 inward moving the disk 206 and the disk leader 202 horizontally towards pin 200 and by that unlocking cylinder 52 of the right cylinder-step 12.

Referring to FIGS. 1–5, and FIG. 8, in a method for the use of a preferred embodiment in accordance with the present invention, for example, the system 15 enables a user a movable and safe elevated working environment, while user feet safely secured inside the pedals 58 comfortably located on top of both cylinder-steps 14 and 12 of the preferred embodiment. Left and right cylinder-steps 14 and 12, attached to top of the base plates 64 which desired for stability of the preferred embodiment, enable the user to lift every cylinder-step individually by pulling it up until conical edges of every cylinder, shown best in FIG. 3, will be in full contact and security pushpins 56 will lock these cylinders 50, 52, and 54 in their fully extended position. System 16, being best shown in FIG. 6, located beneath the pedals 58 on both cylinder-steps 12 and 14, is provided in order to unlock cylinders 52 and 54 of the left cylinder-step 14 and cylinder 54 of the right cylinder-step 12, by horizontally rotating the pedal 58 clock-wise releasing one member and counter-clock-wise releasing the other one. Rotating the pedal 58 in one direction pulls the wires 106 or the like and by that pulling pins 108, being best shown in system 18 in FIG. 6, inward unlocking corresponding single cylinder and after that the user just need to push down, using his weight, in order to lower the cylinder-step of the preferred embodiment. Rotating the pedal 58 the other direction unlocks the other cylinder by using exactly the same method. Every pedal 58 include foot side support 60 to provide better safety, stability and efficient rotation of the pedal, to unlock members of cylinder-step, which is done by user feet.

Referring to FIG. 7, in a method for the use of a preferred embodiment in accordance with the present invention, system 20 enables the user to unlock middle cylinder 52 on the right cylinder-step 12 in order to unlock that cylinder-step. Lifting up pivotally rotating trigger 70, shown in FIG. 1, pulls pin 200, via wire 86 or the like, which in turns release pressure on the disk leader 202. Built-in springs 208 pulls the pins 204 inward moving the disk 206 and the disk leader 202 towards pin 200 unlocking cylinder 52 of the right cylinder-step 12, what is left is for the user to push down in order to lower telescopically cylinder 52 into the lower cylinder 50 of the right cylinder-step 12.

Pulling up each cylinder-step individually, until safety pins 56 will lock each member in its fully extended position, while user feet safely secured inside provided pedals 58 can individually extend each telescopic cylinder-step 12 or 14 up.

Telescopic hand support systems 22 and 24, which attached to the base plates 64, provided for better user stability. Each hand support system can be manually extended or folded, individually, in telescopic manner. Push pins 80 provided to secure each system tubular member in its fully extended position. Tube 82 is connecting the top of both hand support systems 22 and 24 in such a manner so every hand support system can be moved vertically and horizontally independently from the other one. Left hand support system 24 connected to the base plate 64 via pivotally rotating strap 74 which provide the ability to position left hand support system 24 on the side or on the front of the base plate 64 to provide more flexibility and better stability of the preferred embodiment in it's fully or partially folded position. Hook 78, attached to the top of the left hand support system 24, is provided for extra hanging ability for the tools, cans and the like. Tools tray 84, located conveniently on the top of the hand support system attached to tubular member 82.

In accordance with the present invention, the particular embodiments set forth above for the system 15 are capable of providing a telescopic stool for enabling a user safe, efficient, and practical elevated working environment, as well as to climb up or down relative to a surface, enhanced horizontal mobility, and height adjustability. However, other forms of the system 15 may be utilized with the present invention without departing from the spirit and the scope of the invention. Based on the present disclosure, other constructions and applications are known to one skilled in the art.

In view of the above, it is apparent that the system and method of the preferred embodiments of the present invention enhance substantially the practicality and effectiveness of enabling a user to work and to move horizontally safely on self-adjustable elevated working platform. The system and the method further enable simple and convenient height adjustability and horizontal mobility.

While the present invention has been described in connection with the specific embodiments identified herein, it will be apparent to those skilled in the art that many alternatives, modifications and variations are possible in light of the above description. Accordingly, the invention is intended to embrace all such alternatives, modifications and variations as may fall within the spirit and scope of the invention disclosed herein.

What is claimed is:

1. An improved device, providing a user elevated safe working environment, enabling the user to climb up or down for movement relative to a surface, as well as providing increased horizontal mobility, portability and foldability, said device comprising:

i. a pair of stability plates, located at the bottom of said device, providing the user safety and stability while using the device;

ii. a pair of telescopic cylinder-steps, located on top of said stability plates, enabling the user individual telescopic height adjustability of said device;

iii. a pair of pedals providing a user with feet support, located on top of said telescopic cylinder-steps, enabling full control of horizontal motion of said device and individual height adjustability of said telescopic cylinder-steps;

iv. means for unlocking individual members of said telescopic cylinder-steps;

v. a vertical plate connecting the bottom of said telescopic cylinder-steps, providing safety and full stability of the device;

vi. means pivotally connecting between said vertical plate to said cylinder-steps;

vii. a pair of telescopic hand support systems attached to said stability plates;

viii. means for pivotally connecting said telescopic hand support system to each other enabling the user horizontal mobility and independently height adjustability of each of the hand support system;

ix. means for providing the user safe and comfortable access to his tools while being elevated.

2. The device of claim 1 wherein said a pair of telescopic tubular cylinder-steps, comprises plurality of hollow cylinders disposed vertically in telescopic manner one into another.

3. The device of claim 2 wherein said hollow cylinders, each having a built-in safety pin, constantly pushed outward by built-in springs, to secure the respective cylinder in its fully extended position.

4. The device of claim 3 wherein said hollow cylinders, each said cylinder has a built-in conical edge that will be in full contact with corresponding conical edge of another said cylinder, to prevent freedom of movement when the cylinders will be in their fully extended position.

5. The device of claim 2 wherein said pair of pedals, located on top of an upper of said hollow cylinder, comprising a foot support for user's foot stability and to provide the user comfortable pull up of each said hollow cylinder individually for height adjustability, as well as providing comfortable horizontal rotation ability, of said pedal, and to enable the user to unlock said hollow cylinders.

6. The device of claim 2 wherein said means for unlocking each of the members of said telescopic cylinder-steps, include means, located beneath each said pedals, that provides horizontal rotation of said pedals and unlocking each said hollow cylinder individually, enabling the user to adjust the height of the device.

7. The means device of claim 6 wherein said means that provides horizontal rotation of said pedals, further include wires, so by rotating said pedal clock-wise will pull the wires and in turn will pull pins, located at the bottom of each said hollow cylinder, inward providing free vertical telescopic slide of one cylinder into a slightly larger cylinder beneath it, rotating said pedal counter-clock-wise will unlock, the other cylinder of the same cylinder-step.

8. The device of claim 1 wherein said means for unlocking the members of said telescopic cylinder-steps, include means for unlocking a middle cylinder of one of said cylinder-steps.

9. The device of claim 8 wherein said means for unlocking a middle said cylinder of one of said cylinder-steps, include a pivotally rotating trigger located on the top of corresponding said hand support system providing a manual switch for unlocking said middle cylinder of one of the said cylinder-step.

10. The device of claim 9 wherein said pivotally rotating trigger, is connected by wires to unlocking mechanism located at the bottom of the middle cylinder on one of said cylinder-step.

11. The device of claim 10 wherein said unlocking mechanism, comprises a plurality of safety pins pulled inward by built-in springs when said pivotally rotating trigger is flipped up pulling said wires and pulling back a control pin releasing the pressure on a disk which prevents the safety pins from moving.

12. The device of claim 1 wherein said vertical plate connecting the bottom of said telescopic cylinder-steps, is a rectangular shaped vertical plate pivotally connected to lower said cylinders of each said cylinder-steps.

13. The device of claim 1 wherein said pivotally connecting means connecting said vertical plate to said tubular cylinder-steps, are pivotally rotated connectors connecting lower cylinders of said telescopic cylinder-steps to said vertical plate providing horizontal mobility of each said cylinder-step individually.

14. The device of claim 1 wherein said a pair of telescopic hand support systems, comprises tubular, manually operated, telescopic members which are secured in their fully extended position by built-in pushpins.

15. The device of claim 1 wherein said means for pivotally connecting said telescopic hand support, to each other comprising is a tubular member connected to the top of said hand support systems by pivotally rotating connectors providing vertical and horizontal mobility to each of the hand support system individually.

* * * * *